United States Patent [19]

Puccinelli et al.

[11] Patent Number: 4,815,563

[45] Date of Patent: Mar. 28, 1989

[54] ADJUSTABLE POST AND METHOD OF USING THE POST TO ERECT SUSPENSION SCAFFOLDING

[75] Inventors: Joseph S. Puccinelli, Brown Deer; Peter T. Foseid, Milwaukee, both of Wis.

[73] Assignee: Figgie International, Inc., Willoughby, Ohio

[21] Appl. No.: 169,825

[22] Filed: Mar. 17, 1988

[51] Int. Cl.[4] ..... E04G 3/10

[52] U.S. Cl. ..... 182/150; 182/113; 182/128; 248/333

[58] Field of Search ..... 182/150, 142, 143, 144, 182/128, 113; 248/333

[56] References Cited

U.S. PATENT DOCUMENTS

| | | | |
|---|---|---|---|
| 1,153,884 | 9/1915 | Bade | 182/128 |
| 1,725,183 | 8/1929 | Fischer | 182/142 |
| 2,592,315 | 4/1952 | Mosley | 248/333 |
| 3,420,332 | 1/1969 | Textor | 182/128 |
| 3,700,071 | 10/1972 | Kikuchi | 182/150 |
| 3,851,729 | 12/1974 | Gordon | 182/150 |
| 4,163,480 | 8/1979 | Highland | 182/150 |
| 4,413,707 | 11/1983 | Lienhard | 182/150 |

FOREIGN PATENT DOCUMENTS

| | | | |
|---|---|---|---|
| 709781 | 1/1980 | U.S.S.R. | 182/150 |

*Primary Examiner*—Reinaldo P. Machado

*Attorney, Agent, or Firm*—Fuller, Puerner & Hohenfeldt

[57] ABSTRACT

In an adjustable corner post for suspension scaffolding an outer tube is concentric to an elongated member such as a wire rope or rod and has an internal thread in a nut at one end. A tubular adjusting screw having an external thread is concentric to the elongated member and screws into the thread of the outer tube for reacting directly or indirectly with the elongated member so the outer tube rises and lowers when the screw is rotated in opposite directions. A platform supporting structure is supported on the adjustable posts and is leveled by selective rotation of the screws. A method of assembling suspension scaffolding using the adjustable posts is described.

18 Claims, 5 Drawing Sheets

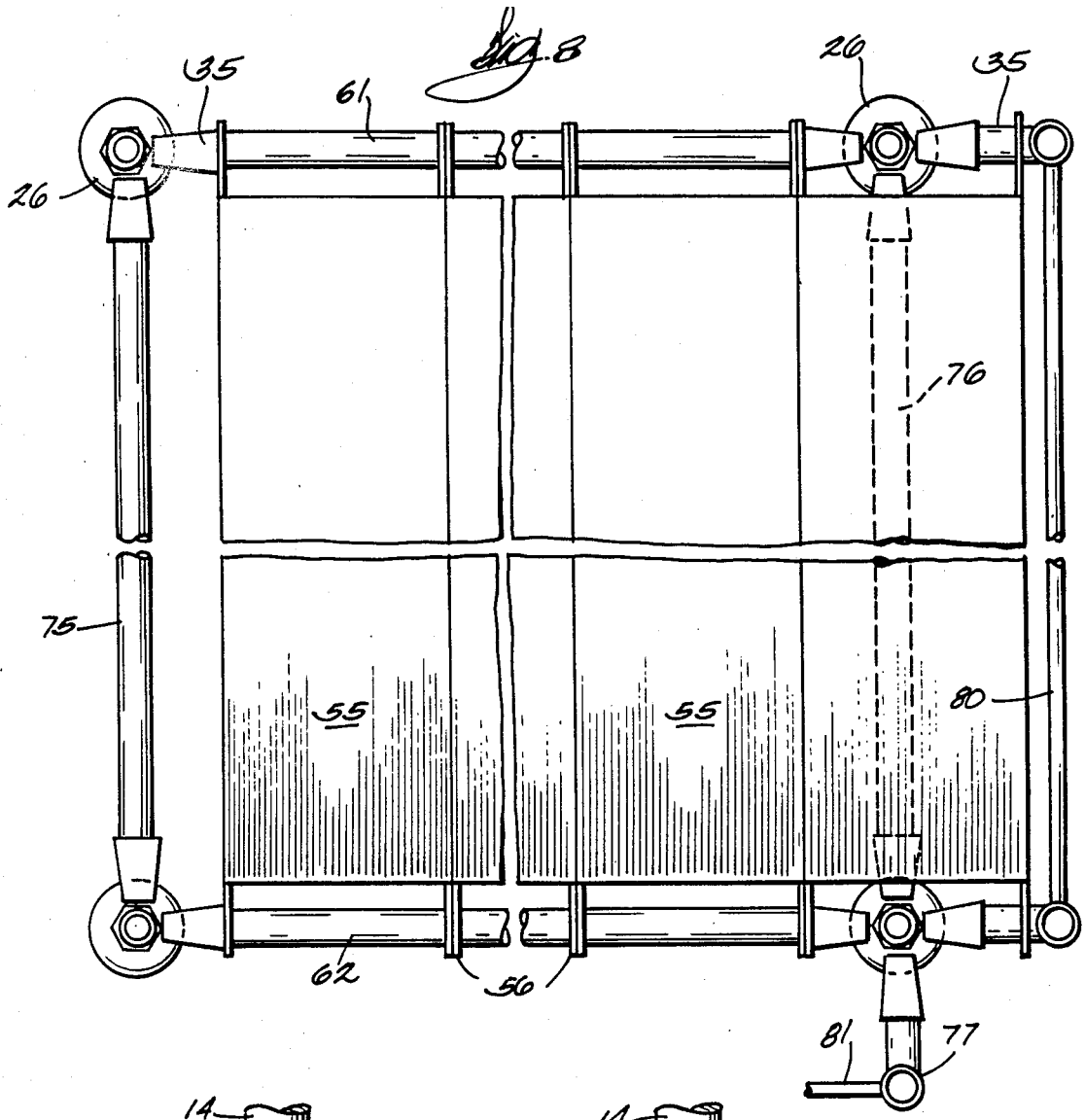
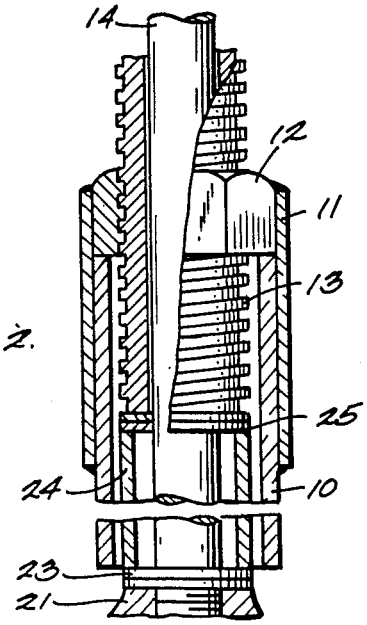
Fig. 2.
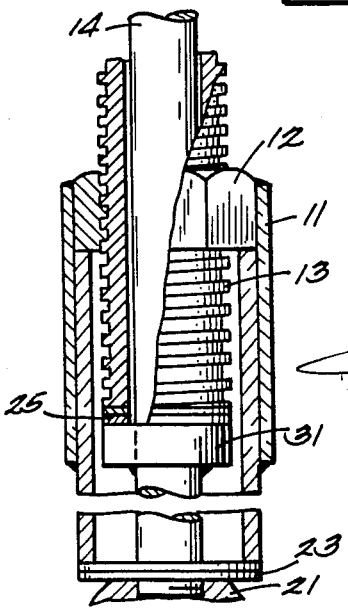
Fig. 2.A

ADJUSTABLE POST AND METHOD OF USING THE POST TO ERECT SUSPENSION SCAFFOLDING

BACKGROUND OF THE INVENTION

The invention disclosed herein pertains to suspension scaffolding and to a post assembly that facilitates erecting scaffolding. The post assembly has other uses too.

To perform maintenance work in places such as under the ceiling of a high room or in a cathedral or inside of a huge boiler that is used to generate steam for an electric power generating plant, there are often interferences or other reasons for not building a scaffold from the floor up to where the maintenance or other work is to be performed. In large boilers it is often necessary to work on the superheater tubes at the top of the fire chamber from a position under the tubes, for example. In such cases it is desirable to have scaffolding that is suspended, for example, from wire ropes or chains which are anchored above the level at which the platform is desired. In some cases it is advantageous to assemble the scaffolding at floor or ground level and hoist it up and in other cases it is preferable to assemble the scaffolding in the free space at the level at which the work must be performed.

SUMMARY OF THE INVENTION

An objective of the present invention is to provide various structural members for erecting area suspension scaffolding.

Another objective of the invention is to provide a multipurpose connector means, herein called an adjustable post, which facilitates assembling various types of structural members to form a scaffold at ground level or off the ground and also provides for leveling the platform on the scaffold.

Another objective is to provide the components of a scaffolding system which allow building several scaffold platform supporting modules that are joined with each other in any of four directions so as to permit creating a large area platform for use by maintenance or construction workers.

Another objective is to provide a guard rail post for facilitating constructing a guard rail about the worker's platform.

An important member in the new area suspension scaffolding is the adjustable post. A preferred embodiment comprises an outer tubular vertical post member on which at least one or a vertically spaced apart pair of attachment rings are fastened, preferably by welding. The outer tubular post member has an internally threaded nut fastened in what is nominally its upper end. A tubular level adjusting screw having an external thread screws into the nut internally concentric with the outer tubular post member. A load bearing rod extends centrally through the total length of the externally threaded level adjustment screw and the outer tube and also through a concentric inner tubular element in one embodiment. An eye nut for hanging a post from a wire rope, chain, tube, rod or other elongated suspension means is threaded onto the upper and lower ends of the rod. In one illustrated embodiment the suspension wire ropes extend through the internal tubular element and there is a stop element or thrust element fastened to the wire rope. The stop element acts as a load carrying thrust bearing. The internal tubular element bears on the thrust element which may be washers which are slid on the rod or wire rope and are resting on the lower eye nut which is threaded onto the lower end of the rod or otherwise fastened to the rope. The inner tubular element makes a free fit on the load bearing rod or wire rope as the case may be and extends upwardly to the bottom end of the externally threaded tubular adjusting screw. Thus, if the tubular screw is screwed inwardly of the nut in one end of the outer post tube, the force of the tubular screw reacts against the thrust elements such as the washers on the lower end of the rod or wire rope which washers bear on the eye nut which is screwed onto the lower end of the rod or bears on another form of stop element if a wire rope is used instead of the rod. The screw reacts indirectly against the rod or wire rope. This pulls the outer tubular post upwardly relative to the rod or wire rope and, of course, the eye nut or other element at the upper and lower ends remain at the same level. If the level adjusting screw is turned out of the outer tube, the outer tube moves downwardly relative to the load bearing rod or wire rope.

In one embodiment of the post there are pairs of annular attachment members in the form of rings near the upper and lower ends of the outer tubular post. The rings are analogous to dishes that have a central hole punched in them whose diameter is about equal to the outside diameter of the outer tubular post. The dishes provide upstanding rims. The rings are welded to the outer tubular post. The rims do not have to be formed as a ring. They could be polygonal or any other configuration. Horizontal elongated tubular members constituting runners and trusses connect to the rings by means of connecting members called joints, typical joints being shown in U.S. Pat. Nos. 4,445,307 and 4,586,842 which are incorporated herein by reference. It should be understood, however, that other means for joining the runners or trusses to the adjustable posts could be used and that the invention is not limited to using rings with rims.

Vertically oriented adjustable posts serve as the corners of a platform module. Runners and trusses spanning between the posts can form variously shaped modules such as square, rectangular, polygonal, triangular and even nearly circular modules on which platform planks are placed to provide a surface for the workers.

The new adjustable posts facilitate a simplified method of erecting a suspended area scaffold on the floor or ground or at a high level in free space. The erecting method at a high elevation involves having a ledge or some kind of surface for assemblers to stand on laterally of the area at which the scaffold platform is to be formed. Workers wearing fall-arrest harnesses assemble the first scaffold module by working from the ledge. At least four elongated suspension elements such as wire ropes, rods, chains or the like will be anchored to the building above the elevation at which the platform of the scaffolding is to be established. The free ends of the suspension elements will be dangling at the outset in positions which would align vertically with where corners of a platform module will exist. An adjustable post is used at each corner. Assume, for example, that wire ropes are used as the suspension elements of the scaffold and that the load is carried by rods extending through the tubular posts. Initially, workers on the ledge use a pole to swing the two wire ropes that are most remote from the ledge into their possession. Then the eyes of the eye nuts on the upper ends of the rods of the posts are used to fasten an adjustable collar to each of the two wire ropes. A first horizontally extending tube, called a runner, is then connected by means of joint devices at each end to the pair of rings nearest to the lower ends of the two adjustable posts which are connnected to the wire ropes. Then, using two more joint devices which are also fastened to the lower pair of fastening rings on the outer tube of the post, two more runners are fastened in parallelism with each other and perpendicular to the first horizontally extending runner. Three sides of a rectangle or square are not formed with the runners if a four-sided platform module is contemplated. The last two parallel runners still have free ends. As an intermediate step, the three sided module is usually allowed to yield or swing partly away from the ledge on which the workers are working under the control of a tag line. This positions the free ends of the two side runners nearer to the edge of the ledge. The workers on the ledge then pull in the nearest two dangling wire ropes and use the eyes of the eye nuts on two of the adjustable posts to fasten the posts to the ends of the wire ropes. Then the free ends of the parallel side runners are fastened by means of joint devices to the second pair of adjustable posts and another runner is installed in parallelism with the first runnner. This illustrative assembly with four corner posts connected by runners is allowed to swing outwardly of the ledge so the assembly is supported exclusively on the four wire ropes. If the platform module were to be other than square or other than four-cornered, the procedure would be substantially the same.

The workers then deposit a few metal planks from the ledge onto the first platform module. The planks are like steel channels which span between a parallel pair of runners and provide a temporary platform for the workers which is at a level nearly at the bottom ends of the adjustable posts. The workers then get onto the planks at which time load bearing trusses and runners are passed to the workers on the planks. Runners are then installed on the uppermost pair of fastening rings on the outer posts perpendicular to the two trusses to form a square or rectangular shape. The load bearing trusses are connected with joint devices between posts and onto the uppermost pair of fastening rings on the outer posts. Now, there are two trusses spanning in parallelism between opposite sides of the structure and they provide tubular horizontal members for supporting planks. The next step is for the workers on the lower temporary platform to have additional planks passed from the ledge. The workers install the additional planks so they span between the tops of the parallel load bearing trusses. Then, when there are enough planks installed on the trusses for the workers to stand, they step up from the lower temporary or partial platform. The workers then reach down and bring up the metal planks from the lower temporary platform to form a complete upper platform composed of planks without spaces between them.

Similar platform modules of various shapes can be built sidewise of the original module in any direction since the posts allow for joining runners and trusses in any direction away from the basic module.

The invention also features a new type of guard rail post. The guard rail posts are fastened to the outer tubular members of the adjustable posts at the corners of a scaffold module. Rails are fastened to the guard rail posts to prevent workers from inadvertently walking or falling off the scaffold platform when they are preoccupied with their tasks.

A more detailed description of the new adjustable posts and the other components comprising a suspended platform will now be described in greater detail in reference to the accompanying drawings.

DESCRIPTION OF THE DRAWINGS

FIG. 2 is an enlargement of the upper and lower ends of the outer tube which forms part of the adjustable post depicted in the previous figure, the view being taken between the arrows 2—2 in FIG. 1;

FIG. 2A is an alternative to the structure shown in FIG. 2;

FIG. 8 is a plan view of the module in FIG. 6 with a guard rail added;

DESCRIPTION OF A PREFERRED EMBODIMENT

Figure 1:
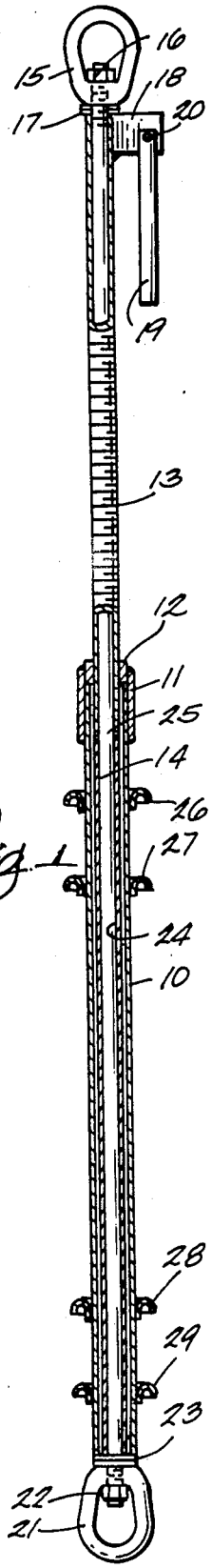
FIG. 1 is a vertical side elevational view, partly in section, of the new adjustable post which is used with other posts to construct suspended scaffold modules.

Attention is invited to FIGS. 1 and 2 for a description of the new adjustable post which may be used for constructing all metal suspended scaffolding modules on the floor for being lifted to a work level or the modules may be constructed in the air at the work level. The post comprises an outer tubular member 10. A sleeve 11 is welded to the upper end of outer tubular member 10. An internally threaded element such as a nut 12 is welded concentrically and inside of the sleeve 11. A tubular externally threaded level adjusting screw 13 is screwed into the nut which is fastened in outer tubular post member 10. A round rod or bolt 14 is long enough to extend through the combined length of the adjusting screw 13 and outer tubular member 10. The adjusting screw has an axial bore so the screw fits concentrically on the rod. The upper end of the bolt 14 is threaded and an eye nut 15 is screwed onto the thread and locked with a nut 16. Washers 17 are interposed between the bottom of the eye nut 15 and the top of adjusting screw 13. A pair of spaced apart bracket plates, one of which 18, is visible, are attached by suitable means, such as welding, to the upper end of adjusting screw 13. A handle or crank 19 is pivotally connected with a pin 20 to brackets 18. The crank facilitates turning adjusting screw 13 inwardly and outwardly of nut 12 in outer tubular member 10.

The bottom end of rod 14 is also threaded and an eye nut 21 is screwed onto the thread and locked by means of a nut 22. This nut is preferably secured on the thread of the rod by welding since the post can be disassembled, if desired, by taking off upper end 16 and eye nut 15. The lower end of inner tubular member 24 rests on washers 23 which are retained by eye nut 21. There is an inner tubular element 24 for transmitting an axially directed force loosely fit over central rod 14 in the FIGS. 1 and 2 embodiment. Washers 25 are interposed between the lower end of externally threaded tubular adjusting screw 13 and the upper end of inner force-transmitting tubular member 24. The lower end of inner tubular member 24 always rests on and reacts against the lower washers 23. Outer tubular member 10 is presently in its lowest possible position of adjustment relative to rod 14 in FIG. 1.

There is an upper pair of joint attachment rings 26 and 27 and a lower pair of rings 28 and 29 welded onto the exterior of outer tubular post member 10. These attachment rings are somewhat similar to a dish with a hole in its center for sliding over the outer tube 10. The rims of the dish are bent upwardly and downwardly so that there is an annular depression 30 between the rims and the periphery of outer tube 10. The configuration of the rims and the annular depression allows for joint devices to be fastened to the upper 26, 27 and lower 28, 29 pairs of rings. The joint devices are provided to allow for connecting horizontal members to the new vertically oriented adjustable posts. Typical suitable joint devices are shown in the previously cited U.S. Pat. Nos. 4,445,307 and 4,586,842 which were designed for use in scaffolds of the conventional type in which the first tier of scaffolding rests on the ground rather than being suspended and in which the posts are not adjustable. These joint devices have upper and lower hooks which hook onto the pairs of rings with their tips in the depressions of the rings. A typical joint is shown diagrammatically in FIG. 7, for example, where the joint body is marked 35. As in the joint devices depicted in the patents, the joints are locked onto the rings 28 and 29 by means of a wedge 36 which the workmen drive in after the joint body 35 is hooked onto the rings 28, 29, for example. These are illustrative means for fastening runners and trusses to the adjustable posts. In some designs there is only one upper ring 26 and one lower ring 29. Joint devices, not shown, which clamp onto the outer tubular member 10 of the post and do not require the attachment rings can also be used.

It should be evident in FIGS. 1 and 2 that if tubular inner adjusting screw 13 is turned with crank lever 19 so that the tubular screw 13 advances into nut 12, the lower end of the screw will apply a force to the washers 25 by way of the inner force-transmitting tube 24 of the post assembly. This axial force reacts against the lower washers 23 which, in turn, are stopped by eye nut 21 on rod 14. Thus, since the adjustment screw 13 is effectively reacting against the long rod 14 by way of the stop means and is screwing into the outer tubular member 10, the outer tubular member begins to elevate relative to the rod 14. As will be elucidated later, since the platform for the workers on the scaffolding is attached to the rings 26, 27 on the adjustable post in the illustrated embodiment, advancing and retracting adjustment screws 13 in the posts will raise or lower, respectively, a platform supported on the posts for the purpose of leveling the platform.

The alternative structure in FIG. 2A is similar in most respects to FIG. 2 with two exceptions. The first is that the inner force-transmitting tube 24 of FIG. 2 is omitted and the second is that a collar 31 is fastened to rod 14 by welding, preferably. In this case, when tubular adjusting screw 13 is turned in, the screw reacts against collar 13 which is part of the rod so outer platform supporting tubular member 10 rises. Conversely, if the screw 13 is backed out of threaded nut the outer tube moves oppositely or downwardly.

Other components of the large area suspended scaffolding and at a least a partial repetition of some of the steps connected with conveniently assembling the scaffolding will now be discussed.

Figure 3:
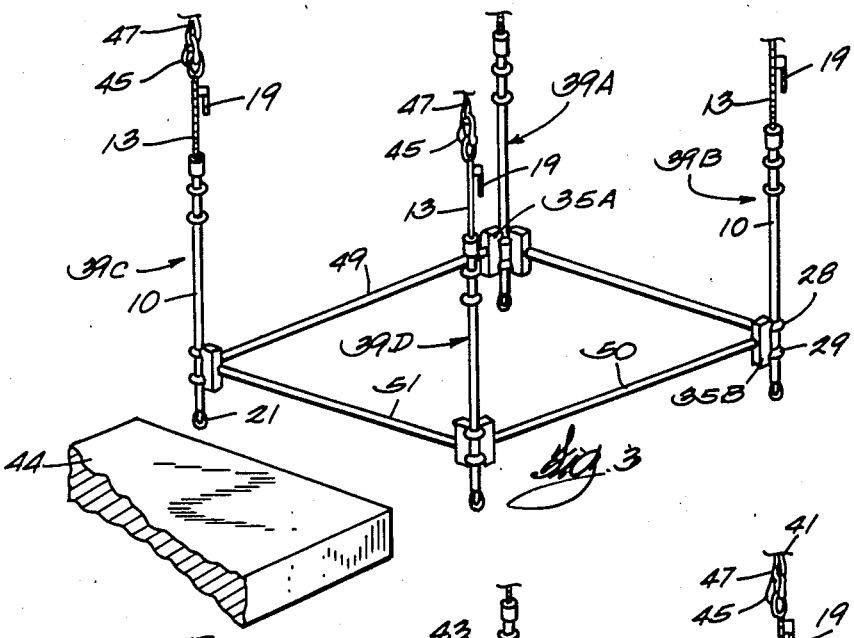
FIG. 3 shows a suspended basic scaffold module hanging in free space and constructed substantially in the manner described earlier in this specification.

Attention is now invited to FIG. 3 which shows a partially assembled scaffolding module. In FIG. 3 there are four wire ropes 40–43 which are initially dangling from some point of attachment above the elevation at which the platform of the scaffolding is to be positioned. For example, in the fire chamber of steam boiler, not shown, before assembly of a scaffold begins, anchors, not shown, are installed somewhere at a high level in the boiler and groups of four related wire ropes for one scaffold would be hung from the anchors. So, referring to FIG. 3, workers who may be standing on a ledge 44 or other temporary worker's support, which is shown schematically in FIG. 3, would use a pole having a hook on its end, not shown, for pulling wire ropes 40 and 41 toward the workers on ledge 44. Then, using a shackle, such as the one marked 45 in FIG. 7, having a locking pin 46, would be passed through the wire rope thimble 47 of the wire ropes and then the shackle would be connected to the eye nut 15 of the adjustable post and locking pin 46 is screwed into the shackle. In FIG. 3 the adjustable posts are generally designated by the reference characters 39A, 39B, 39C and 39D. All of the adjustable posts are hung on the ends of the dangling wire ropes, chains, tubes or rods, 40–43 in due course.

Figure 7:
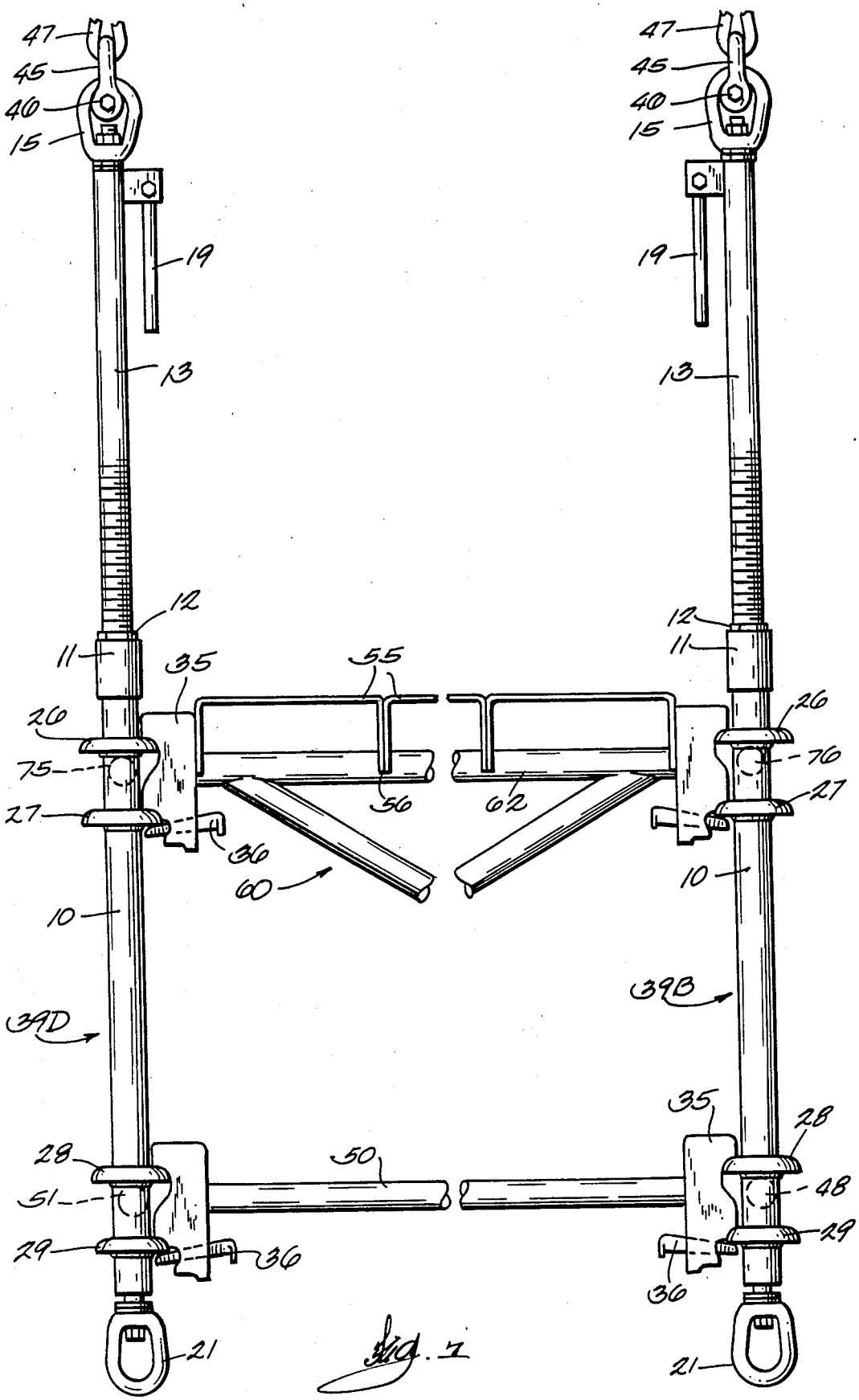
FIG. 7 is a divided and contracted side elevational view of the scaffold module depicted in FIG. 6.

Referring to FIG. 3 again, now that the pair of wire ropes 40 and 41 most remote from ledge 44 have adjustable posts 39A and 39B hung on them, the posts are connected together by means of a first runner tube 48. Connections are made by joint devices, a typical one of which in FIG. 3 is marked 35. These joint devices are basically the same as the joints described in the two cited patents. Of course other runner end attachment means such as split clamps, not shown, could be used. A little larger view of a typical joint 35 is shown in FIG. 7 locked onto the lower pair of rings 28 and 29 on outer axially movable tube 10 of the adjustable post with a tapered wedge 36.

Referring to FIG. 3 again, after the first runner 48 is connected between the adjustable posts 39A and 39B on wire ropes 40 and 41, another joint device 35A is fastened to the post for wire rope 40 and a second tubular runner 49 is thereby installed. Similarly, a runner 50 is installed using joint 35B. At this time, the frame is comprised of first runner 48 and parallel runners 49 and 50 which have free and unattached ends.

Wire ropes 40 and 41 support the three sided frame which is allowed to swing out somewhat away from ledge 44 but no farther than to have the free ends of runners 49 and 50 remain accessible to the workers on the ledge. Then using another set of joints 35 a fourth runner 51 is installed in parallelism with the first runner 48 so that a four sided frame comprised of tubular runners 48–51 is formed. Since this assembly is now supported on wire ropes 40–43 through the agency of the adjustable posts 39A–39D at the corners, the workers can and do push the assembly away from ledge 44 but within their reach as is the case in FIG. 3.

Figure 4:
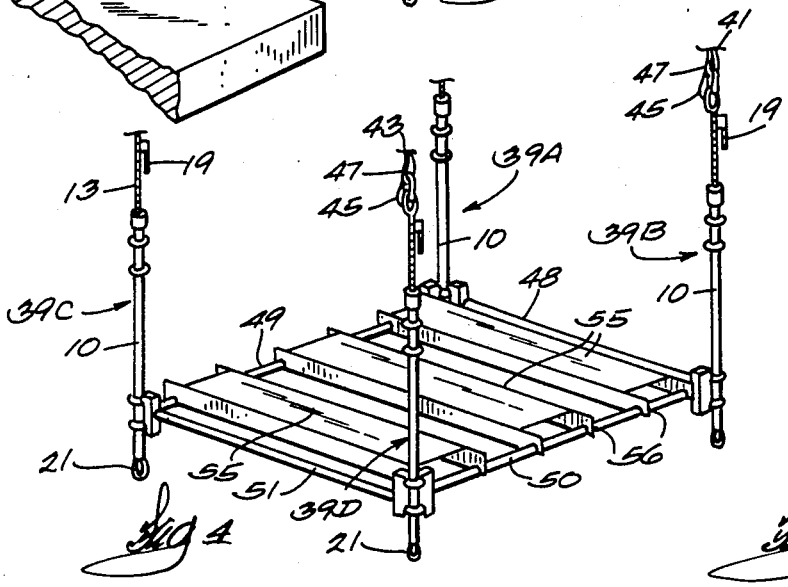
FIG. 4 is similar to the preceding figure except that planks are installed on the module to provide a temporary work platform.

Then, while standing on the ledge 44, the workers deposit a few metal planks 55 on the assembly to form a partial and temporary platform. The planks have sidewalls with hooked ends 56 so the planks are prohibited from sliding off of the runners. FIG. 4 shows three planks 55 in place and there are gaps between them so as to constitute a lower temporary platform. The workers now step onto the planks of the temporary platform.

Figure 5:
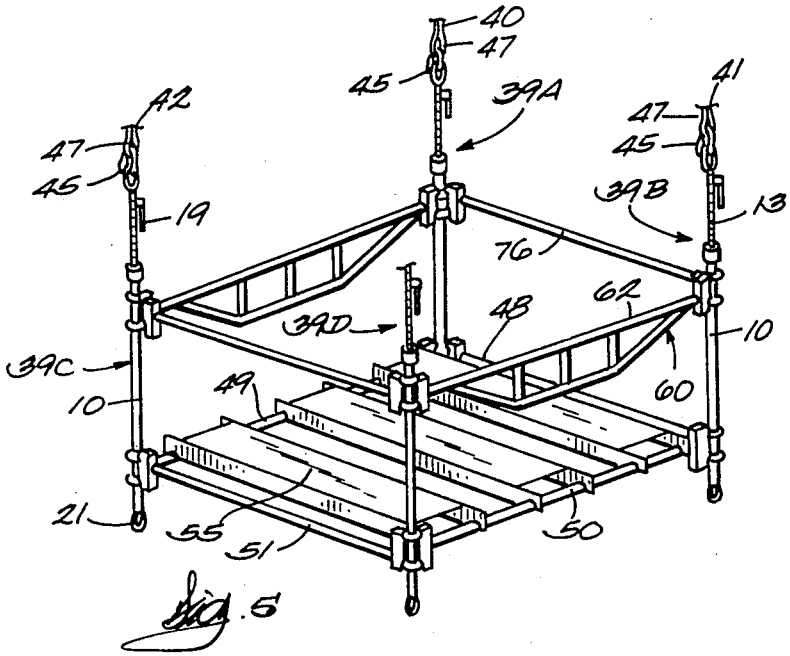
FIG. 5 shows the modules with the load bearing trusses installed.

Referring to FIG. 5, when typically two workers are on the platform, load bearing trusses 59 and 60 are passed to them and they are installed. These trusses have upper horizontal tubular members 61 and 62 which are comparable to runners and they facilitate mounting the trusses to the corner posts with joint devices 35. Before or after the tresses 59 and 60 are installed, runners 75 and 76 are installed.

The next thing to do is level the structure. This is done by placing a level instrument, not shown, on the top of the truss tubes 61 and 62 and runners 73, 74 and then turning the adjustment screws 13 with the crank handles 9 selectively to variously raise or lower the outer tubes 10 of the adjustment posts as required to obtain a level platform. The leveling procedure is to place a level at one of the corners such as to span from runner 75 and truss tube 61, for example. After adjusting post 39C so the leveling instrument shows level, this level becomes the datum level and leveling is continued along the trust tubes and runners around the structure. Levels are achieved by adjusting the posts. The platform planks are not used for leveling because they could be slightly warped.

Figure 6:
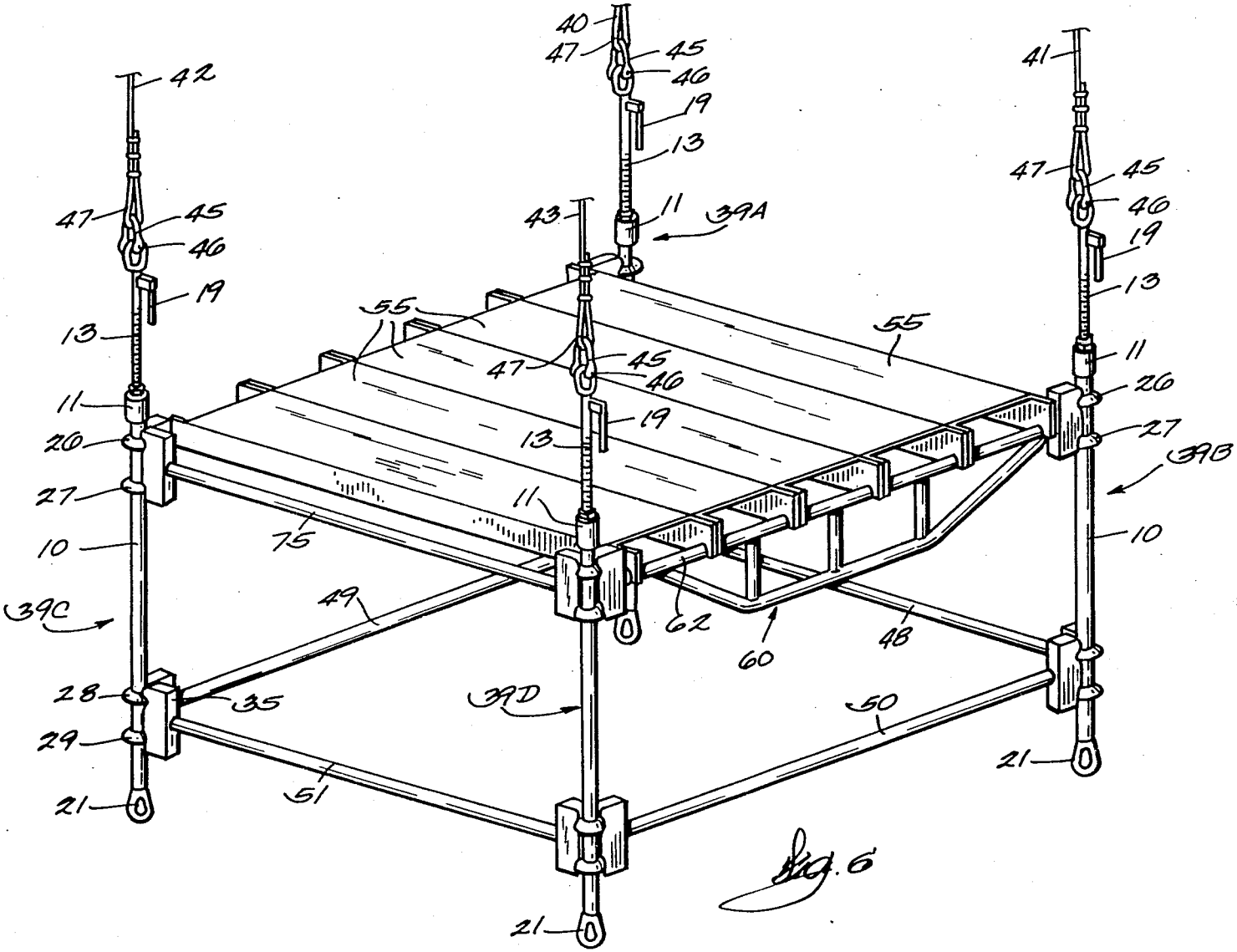
FIG. 6 shows a completed suspension scaffold module before any guard rail is installed for the platform.

FIG. 6 shows a completed module except that no guard rails have been installed on it yet. The change that has been made in FIG. 6 over FIG. 5 is that all of the planks 55 are now supported on the load bearing trusses 60. Previously, while the workers were still standing on the lower temporary platform planks as in FIGS. 4 and 5, additional planks were passed to them from workers on the ledge 44. These additional planks are installed on the top cross tubes 61 and 62 of trusses 59 and 60. Then after some planks are deposited on the trusses, the workers climb up onto the trusses and kneel down and pick up the planks that had formed the partial or temporary platform at the lower level and they bring the planks up and install them with the others on the trusses to produce a platform without gaps as depicted in FIG. 6.

FIG. 7 shows a side elevational view of the completed scaffold platform module. FIG. 8 shows a plan view of the module in FIG. 7 but in FIG. 8 one guard rail section has been attached as will be discussed in greater detail shortly hereinafter.

It should be apparent from FIGS. 6–8 that when the first module is complete, there is a place for workers to stand to build out additional modules and a continuous platform in any direction. A so called swing platform could be suspended from the lower eye nuts on the posts of an upper level platform to provide two tiers. Considering FIG. 8, for example, one may see that it is now easy to assemble additional modules to provide a much larger area suspension platform. At the corners of the first completed module there are the adjustable posts with the two pairs of rings 26, 27 and 28, 29 on them. None of the rings has any more than two joint devices 35 fastened to it. The two that are fastened to any of the rings are spaced apart by 90° around the axis of the adjustable post. However, there is space around the posts for fastening additional joint devices at least every 45° for the purpose of constructing scaffold and platform extensions of various shapes from any side of the first module that is completed.

Another method of installing the suspended scaffolding is to assemble a first complete module at ground or floor level and then hoisting the module to the desired elevation in free space above. Additional modules can be constructed and hoisted to the level of the first one and attached to it by workers standing on a previously elevated module. Also, the first elevated module can be used as a platform by workers to assemble and join additional modules, not on the ground, but in the air.

Figure 9:
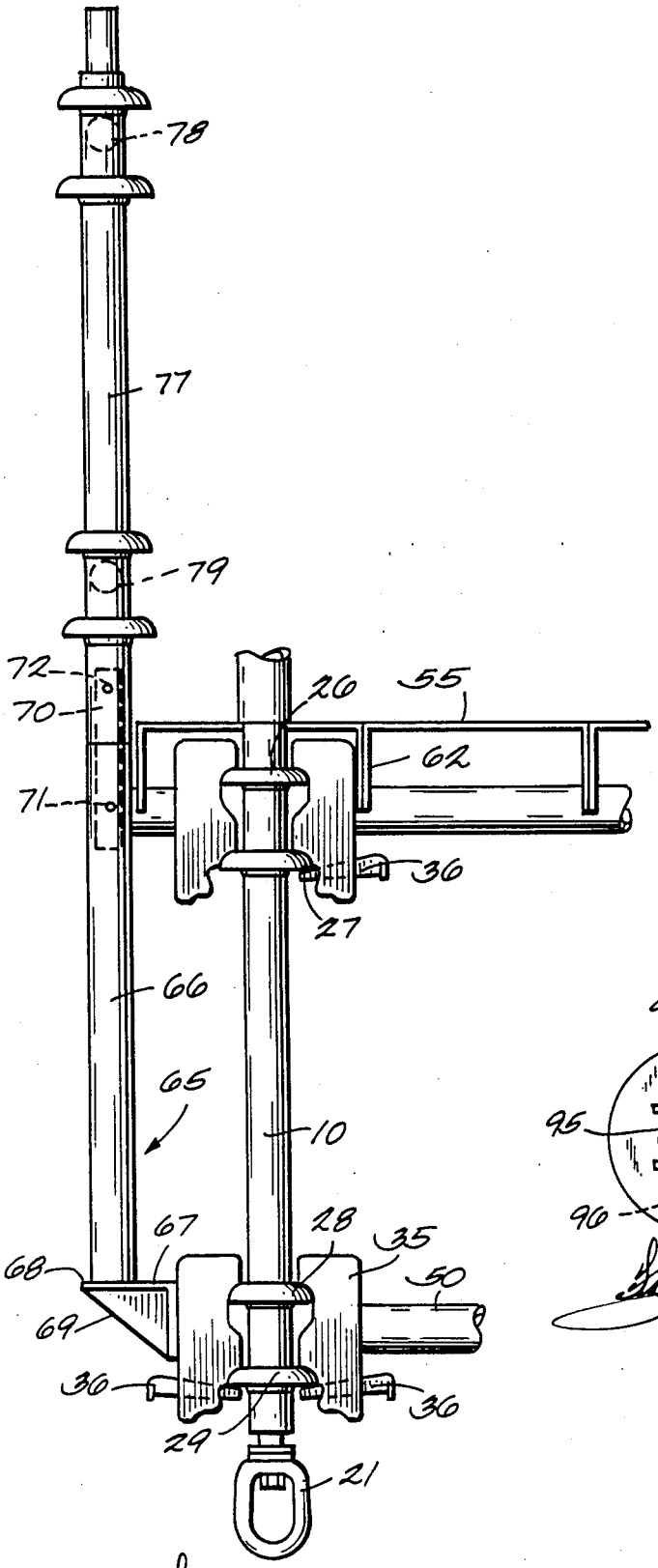
FIG. 9 is a side elevational view of a typical one of the new guard rail posts fastened to one of the new adjustable posts.

Refer now to FIGS. 8 and 9 for a discussion of the manner in which a guard rail is mounted to the suspension scaffold platform. Referring to FIG. 9, one may see that the guard rail bracket, generally designated by the numeral 65, is mounted to an adjustable post outer tubular member 10 in the customary manner using the upper pair of rings 26, 27 and the lower pair 28, 29. The guard rail bracket comprises a tubular post 66 which is welded at its bottom end 67 to an angular member 68 which is reinforced with a gusset plate 69. Angular member 68 is welded onto a joint device 35. The joint device is shown secured already by reason of wedge 36 having been driven home to lock the joint device 35 onto the lower rings 28, 29 of the post 10. The bracket is provided with coupling pin 70 which can telescope into tube 66 of the guard rail bracket assembly. There is a hole 71 in opposite sides of upstanding tube 66 of the guard rail bracket assembly which is used to fasten coupling pin 70 to tube 66 by driving a roll pin into hole 71 to fix the telescoping member 70 at a definite level. A guard rail post 77 is telescoped over tube 66. The upper end of telescoping member 70 is provided with a hole 72 for anchoring the guard rail post to the guard rail bracket. Horizontal tubes 78 and 79 such as those shown in hidden lines in FIG. 9 and those 80 and 81, shown in FIG. 8, are then used as horizontal guard rails attached to the vertical posts. In FIG. 9, the joint devices for attaching rails 78 and 79 to the guard rail post are not shown but FIG. 8 illustrates how the rails are attached.

Figure 11:
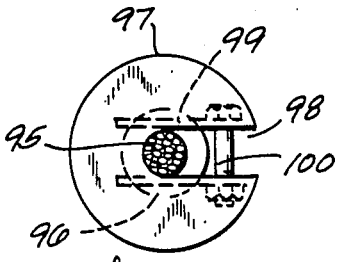
FIG. 11 is a transverse section taken on a line corresponding to 11—11 in FIG. 10.
Figure 10:
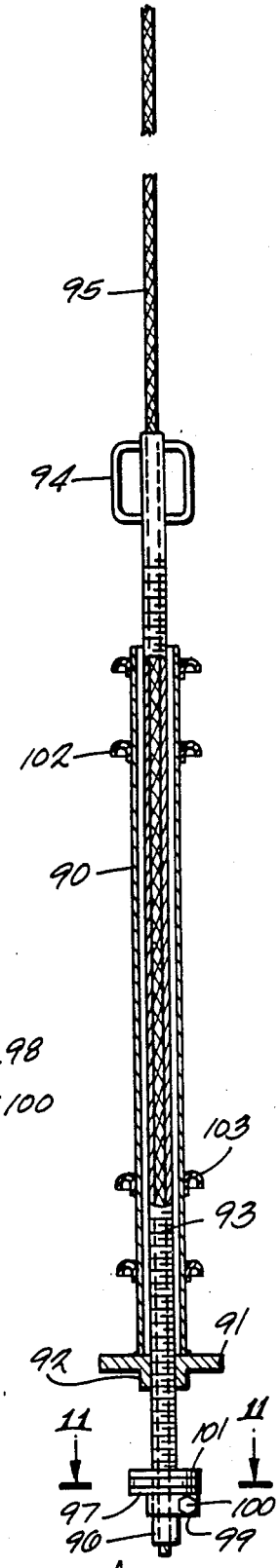
FIG. 10 is a vertical side elevational view, partly in section, of an alternative embodiment of the new adjustable post.

FIGS. 10 and 11 show an alternative embodiment of the new adjustable post based on principles disclosed in the previously discussed embodiment. The FIG. 10 embodiment comprises an outer tube 90 which has what is called an inverted nut 91 fastened to its lower end by any suitable means such as welding. The nut has an internally threaded bore 92. A long tubular member 93 having an external thread screws into the threaded hole 92 of nut 91. Externally threaded tubular member 93 has a pair of handles 94 at its upper end for turning it in threaded hole 92. A load bearing member such as a wire rope extends through the axial length of externally threaded internal tube 93. It is assumed that the upper end of wire rope 95 is anchored in the top of a building or boiler or wherever the adjustable post of FIG. 10 will be used to assemble a platform that is adapted for being suspended off the ground or floor. A rod or chain or other elongated member could be used in place of wire rope 95 for supporting the load. In this example, wire rope 95 terminates at its lower end in a stop member 96 that is suitably fastened, such as by swaging it to the table. As shown in FIGS. 10 and 11, a washer 97 having a lateral slot 98 is supported on the fitting or stop member 96. There are a pair of vertical flanges 99 fastened to the bottom of washer 97 by any suitable means such as welding. A bolt 100 retains the washer on the wire rope. As shown in FIG. 10, there are some additional washers 101 resting on washer 97. Washers 101 are made of a low friction material. Washers 101 act as thrust bearings for the lower end of externally threaded inner tube 93 which bears on the washers.

External tube 90 is provided with upper and lower annular rings 102 and 103 which provide one way for attaching runners as in the previously described embodiment. It should be understood, however, that the principles of the adjustable post depicted in FIG. 10 can be fulfilled by means other than pairs of rings 102 and 103 are used to attach runners and trusses. There are well known commercially available clamps that facilitate connecting a runner, for example, at right angles to a vertical tube such as outer tube 90.

In the FIG. 10 embodiment, the outer tube 90 supports the weight of the scaffolding platform. In the FIG. 10 design as well as the previously described design, the elevation of attachment rings 102, for example, relative to the wire rope, determine the elevation of the scaffolding platform structure. Hence, to raise and lower the platform structure for the purpose of leveling it, for example, handles 94 are used to turn the externally threaded inner tube 93 in one direction or the other. Tube 93, in effect, is applying a force to wire rope 95 through the agency of slotted washer 97, stop fitting or stop member 96 and washers 101. Since external tube 90 is held against rotation, it and the platform structure attached to it will raise and lower relative to wire rope 95 depending on the direction of rotation in which externally threaded inner tube 93 is turned.

Although embodiments of the new adjustable suspension scaffolding post and although methods of assembling a suspension scaffold using the posts have been described in detail, such description is intended to be illustrative rather than limiting, for the invention may be variously embodied and practiced so it is to be limited in scope only by construing the claims which follow.

We claim:

1. An adjustable post for being suspended on an elongated member such as a wire rope, chain, rod or the like, comprising:

an outer tubular load supporting member having nominally upper and lower ends, an element having an internal thread coaxial with said outer tubular member, said element being fastened to said member near one of said ends, an externally threaded inner tubular member for being screwed into said element concentric to said outer tubular member, said inner tubular member having nominally upper and lower ends, said elongated member extending through said inner tubular member, and stop means fastened to said elongated member beyond the nominally lower ends of said inner and outer tubular members, the reactive force between said externally threaded inner tubular member and said stop means due to rotating said inner tubular member in one direction about its axis causing said outer tubular member to move up relative to said load supporting member and rotating said inner tubular member in the opposite direction causing said outer tubular member to move down.

2. The adjustable post according to claim 1 wherein:

said elongated member is a metal rod which extends through said inner and outer tubular members and said stop means is fastened to said rod, said rod having a threaded end proximate to said nominally upper end of said externally threaded inner tubular member and eye nut means threaded onto said threaded end for facilitating suspending said post.

3. The adjustable post according to claim 2 wherein said rod has a threaded end proximate to said nominally lower end of said externally threaded inner tubular member and eye nut means threaded onto said threaded end comprises said stop means.

4. The adjustable post according to claim 1 wherein:

said elongated member is a wire rope which extends through said inner and outer tubular members and said stop means is fastened to said wire rope.

5. The adjustable post according to any one of claims 1, 2, 3 or 4 including handle means fastened to said externally threaded inner tubular member for facilitating rotating said member.

6. An adjustable post comprising:

an elongated rod means having opposite first and second ends, an outer tubular member concentric to said rod means, said tubular member having internal thread means at an end nearer to the first than to the second end of said rod means, adjusting screw means having an axial bore for fitting substantially concentrically on said rod means coaxially with said outer tubular member and having an external thread for being screwed selectively inwardly and outwardly of said internal thread means of said outer tubular member, an element for transmitting reactive force between said screw means and said rod means such that when said screw means is rotated in a direction to advance inwardly of the outer tubular member so as to react against said element, said outer member moves in the opposite direction and when said screw means is rotated in a direction to retract outwardly of said outer tubular member said member moves in the opposite direction, and stop means fastened to the first and second ends of said rod means.

7. The adjustable post according to claim 6 wherein said force transmitting element is an inner tubular member substantially concentric to said rod means and interposed between said screw means and the stop means at the second end of said rod means.

8. The adjustable post according to claim 6 wherein said force transmitting element is a collar means fastened to said rod means adjacent the end of the adjusting screw means.

9. The adjustable post according to any one of claims 6, 7 or 8 wherein said stop means at the first end of said rod means has eye nut means for being engaged by a wire rope to provide for suspending said post from said wire rope.

10. The adjustable post according to any one of claims 6, 7 or 8 including a handle pivotally connected to said screw means for rotating said externally threaded screw means in said internal thread of the outer tubular member.

11. The adjustable post according to claim 10 wherein said stop means at the first end of said rod means has means for being engaged by a wire rope to provide for suspending said post from said wire rope.

12. The adjustable post according to any one of claims 6, 7 or 8 wherein said rod means has a thread at its first and second ends and said stop means at the ends, respectively, of said rod means constitute eye nuts screwed onto said threads on the rod ends.

13. The adjustable post according to any one of claims 6, 7 or 8 including attachment means fastened to the outside of said outer tubular member for facilitating attachment of platform structure members.

14. The post according to claim 13 wherein said attachment means are comprised of one pair of axially separated rings fastened coaxially with said outer tubular member near an end of said member containing said internal thread and another pair of axially separated rings fastened coaxially with said outer tubular member near the opposite end of said member.

15. A platform module comprising:

a plurality of the posts defined in claim 1 for being suspended in space, said posts being arranged correspondingly in parallelism to define the shape of platform support structure, elongated runner members spanning between said posts from one post to the next post and joint means for connecting the ends of said runner members to said posts, a first truss member spanning between two of said posts and a second truss member spanning between another two of said posts in parallelism with the first truss member and joint means for connecting said truss members to the posts between which said members span by engaging said outer tubular members, a plurality of metal planks having opposite ends supported, respectively, on said truss members to form a platform, said planks having means for engaging the truss members, and means on said screw means, respectively, for rotating said screw means to selectively advance and retract said screw means relative to said outer tubular members of said posts as required for leveling said truss and runner members.

16. The platform module according to claim 15 having a guard rail structure including guard rail post means for being coupled to said adjustable posts on at least one side of said platform, said guard rail post means comprising:

a first tubular column member and means for fastening said member to said vertical adjustable posts, respectively, in parallelism with said adjustable posts, a second tubular column member and means for joining second column members coaxially with said first members for said second members to extend upwardly from the level of said platform, at least one elongated guard rail member having opposite ends and means for fastening said ends, respectively, to spaced apart second tubular column members.

17. A method of assembling a suspension scaffolding module including a platform for workers comprising the steps of:

anchoring suspension devices selected from the group of wire ropes, chains, rods and the like above the elevation at which said scaffolding is to be assembled such that the suspension devices hang downwardly in positions corresponding generally to the positions of the corners of the platform, the lower ends of the suspension devices being positioned adjacent a work surface for workers performing the assembly, pulling a pair of suspension devices remote from the surface over the surface and fastening the devices, respectively, to a first pair of adjustable posts including tubular members which are retained on said suspension devices and are axially adjustable relative to said suspension devices, connecting opposite ends of a first elongated tubular runner to the tubular members of the posts near the lower ends of the members, connecting corresponding ends of two additional runners to individual adjustable tubular members of the first pair of posts near the lower ends of the posts such that the additional runners extend in the same direction parallel to each other to present their free ends on the work surface, connecting said free ends of the runner, respectively, to the other pair of adjustable posts which are fastened to said suspension devices that were nearer to said work surface than said first pair and fastening another runner between the adjustable tubular members of said other post to produce a frame having an adjustable post at each corner, causing said frame to swing out in suspension adjacent said work surface and depositing some planks on said frame that span from runner to runner on opposite sides of the frame so as to provide a temporary platform, using the temporary platform, install load bearing trusses between the pairs of adjustable posts to which the runners that support the temporary platform planks are supported and fasten the trusses, respectively, at the upper ends of the axially adjustable tubular members of the adjustable posts, then depositing some planks to span between said load bearing trusses to produce a partially completed platform, and next, using the partially completed platform, pick up the planks composing the temporary platform and deposit these planks on said trusses to complete the working platform.

18. The scaffolding assembly method according to claim 17 including the stop of installing guard rails on at least some sides of said working platform.

* * * * *